US006964073B1

(12) United States Patent
Curry

(10) Patent No.: US 6,964,073 B1
(45) Date of Patent: Nov. 15, 2005

(54) MULTI-FUNCTION PATIENT IMMOBILIZATION DEVICE

(76) Inventor: Sandra M. Curry, 111 W. Edison, Williams, AZ (US) 86046

( * ) Notice: Subject to any disclaimer, the term of this patent is extended or adjusted under 35 U.S.C. 154(b) by 0 days.

(21) Appl. No.: 10/993,033

(22) Filed: Nov. 18, 2004

(51) Int. Cl.[7] ..... A47C 27/10; A61G 1/013

(52) U.S. Cl. ..... 5/626; 5/625; 5/627.706; 5/655.3; 128/870

(58) Field of Search ..... 5/625–629, 706, 5/710, 655.3; 128/869, 870, 846

(56) References Cited

U.S. PATENT DOCUMENTS

| | | | | |
|---|---|---|---|---|
| 3,513,489 | A * | 5/1970 | Miller et al. | 5/98.1 |
| 3,897,777 | A | 8/1975 | Morrison | |
| RE28,916 | E * | 7/1976 | Rice et al. | |
| 4,067,075 | A | 1/1978 | Leathers et al. | |
| 4,254,518 | A * | 3/1981 | Buhren et al. | 5/702 |
| 4,301,791 | A | 11/1981 | Franco, III | |
| 4,466,145 | A | 8/1984 | Jones et al. | |
| 4,621,382 | A | 11/1986 | Burriss et al. | |
| 4,907,997 | A * | 3/1990 | Hall | 114/345 |
| 5,016,620 | A | 5/1991 | Matthews | |
| 5,018,226 | A * | 5/1991 | Davies et al. | 5/81.1 R |
| 5,311,882 | A | 5/1994 | Gagne | |
| 5,433,741 | A | 7/1995 | Truglio | |
| 5,560,059 | A | 10/1996 | McQueen | |
| 5,826,583 | A | 10/1998 | Wood | |
| 6,053,534 | A | 4/2000 | Timmerman | |
| 6,138,306 | A | 10/2000 | Muhanna | |
| 6,425,399 | B1 | 7/2002 | Hoster, Jr. | |
| 2003/0106155 | A1 * | 6/2003 | Arai | 5/627 |

* cited by examiner

*Primary Examiner*—Alexander Grosz
(74) *Attorney, Agent, or Firm*—Gregory J. Nelson

(57) ABSTRACT

A multi-function device for immobilizing a patient for administration of medical treatment and transportation to a medical facility. The device has an inflatable base which supports the patient. Inflatable air channels extend around the periphery of the base and when inflated will converge inwardly and will engage the head and body of the patient to restrain the individual. Additional cross body straps may be provided a well as lift straps for air evacuation. The peripheral air channels have access areas so the patient may be accessed for administration of medical procedures such as an IV attachment of a blood pressure cup. The device is made from a durable fabric material and is rapidly inflated by a self inflation device.

16 Claims, 4 Drawing Sheets

MULTI-FUNCTION PATIENT IMMOBILIZATION DEVICE

FIELD OF THE INVENTION

The present invention relates to a versatile support, restraint and immobilization device which is used to stabilize an individual who has suffered injuries and trauma, particularly spinal injuries, prior to transportation of the individual to a hospital or medical facility. The device may be used in a number of emergency situations and environments and permits administration of emergency medical procedures by emergency medical personnel.

BACKGROUND OF THE INVENTION

It is customary emergency medical practice to immobilize individuals who have suffered trauma, particularly trauma to the regions of the head, neck and back. Movement of individuals with injuries in these areas can be particularly perilous and, if improperly administered, can result in further injury, paralysis and even death. Typical situations which involve injuries which require attending emergency medical personnel to immobilize the patient are automobile accidents, falls, skiing accidents and combative patients. Generally the individual must be first stabilized and placed in a horizontal position. Conventional practice is to support the individual on a backboard. Such backboards are usually rigid, planar devices fabricated of wood, metal or plastic. The customary use of a backboard involves placing the board next to the injured patient, gently moving the patient onto the backboard and then securing the patient on the backboard, usually with straps, in order to minimize or prevent movement during initial medical treatment and transportation to a medical facility.

Various prior art patents can be found which disclose various modifications of the conventional backboard.

| | | |
|---|---|---|
| U.S. Pat. No. 3,897,777; | U.S. Pat. No. 4,301,791; | U.S. Pat. No. 4,621,382 |
| U.S. Pat. No. 5,311,882; | U.S. Pat. No. 5,560,059; | U.S. Pat. No. 6,053,534 |
| U.S. Pat. No. 6,425,399; | U.S. Pat. No. 4,067,075; | U.S. Pat. No. 4,466,145 |
| U.S. Pat. No. 5,016,620; | U.S. Pat. No. 5,433,741; | U.S. Pat. No. 5,826,583 |
| U.S. Pat. No. 6,138,306 | | |

However, it has long been recognized that it would be advantageous to provide an emergency immobilization and restraint device which would provide support and stabilization during initial assessment of the patient's condition and administration of medical procedures, as well as during subsequent evacuation and transportation to a hospital facility. Further, there also exists the need for a device of this type which is quickly deployable, comfortable for the patient, which will securely immobilize the patient and yet accommodate administration of necessary medical procedures.

There also exists a need for a multi-function immobilization device which may be used in a wide variety of emergency situations, including accidents such as vehicle collisions, falls, airplane accidents and sport-related injuries. These situations often involve and require treatment and transportation from snow conditions, water environments and sometimes require air evacuation of the injured.

Accordingly, in recognition of the various deficiencies of prior art devices and the needs set forth above, the present invention provides a versatile immobilization device which can be used in numerous situations and environments where a patient has suffered injury or trauma, which device will facilitate immediate assessment and treatment of the patient and provide immobilization for patient removal and transportation to a hospital location.

BRIEF SUMMARY OF THE INVENTION

Briefly, the immobilization device of the present invention includes an inflatable underlying base support, preferably of a durable fabric material which, when inflated, will become rigid and which is radio opaque. When uninflated, the device is compact and easily storable in a convenient location such as in an emergency medical vehicle. The immobilization device is generally elongated and is preferably provided with drain holes to allow passage of moisture which may accumulate in certain rescue situations. The immobilization device is sized to accommodate an individual in a supine position facing upwardly. The device may be provided in several sizes such as adult, junior and even pediatric. One or more inflatable, resilient cushions extend longitudinally along the upper surface of the base. The base defines a pocket beneath the cushion for insertion of a rigid backboard, if required.

The patient is immobilized by a plurality of peripherally extending air channels which are inflated once the patient is properly positioned on the base. The air channels are arranged in a stacked, upwardly converging relationship around the periphery of the device so that once the patient is placed on the device, the air channels can be selectively inflated to the desired pressure stabilizing and securing the patient in place engaging the body and the top and front of a patient's head. A collar such as an extrication collar may be provided in the cervical region for immobilizing the head and neck. Since the immobilized patient is encircled by the inflated, peripheral air channels, patient access is provided between adjacent channels so that attending emergency medical personnel can assess the condition of the patient and reach areas such as the patient's limbs for monitoring vital, signs such as blood pressure, facilitates administering treatment such as IVs' or drugs. Inflation is accomplished by rapid, self inflation devices such as a cartridge of compressed air. A small heater may be attached to circulate warm air into the channels surrounding the patient for the rewarming process in hypothermia cases or for patient comfort. An air relief valve may be provided so the medical attendant can control the degree of inflation. A gauge may indicate the inflation pressure.

In addition to the peripheral air channels, the device includes multiple retention belts which can be placed around the patient, such as around the chest, leg and foot regions. The belts may be secured initially or after placing a suitable blanket or body covering over the patient if required.

Lifting straps may be attached to the base. Preferably the straps terminate in D-rings which may be secured to a wire cable or hoist to elevate the patient as may be necessary in certain rescue conditions such as water situations. Handles on the base facilitate lifting the patient into and out of a transport vehicle. Also since the device is inflatable, it is buoyant which buoyancy will assist in water rescue conditions.

The device may be used with existing devices and may be placed in a Stokes basket so the immobilized patient may be lowered or pulled to a safe location, as is often necessary in accidents involving skiers and mountain climbers.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
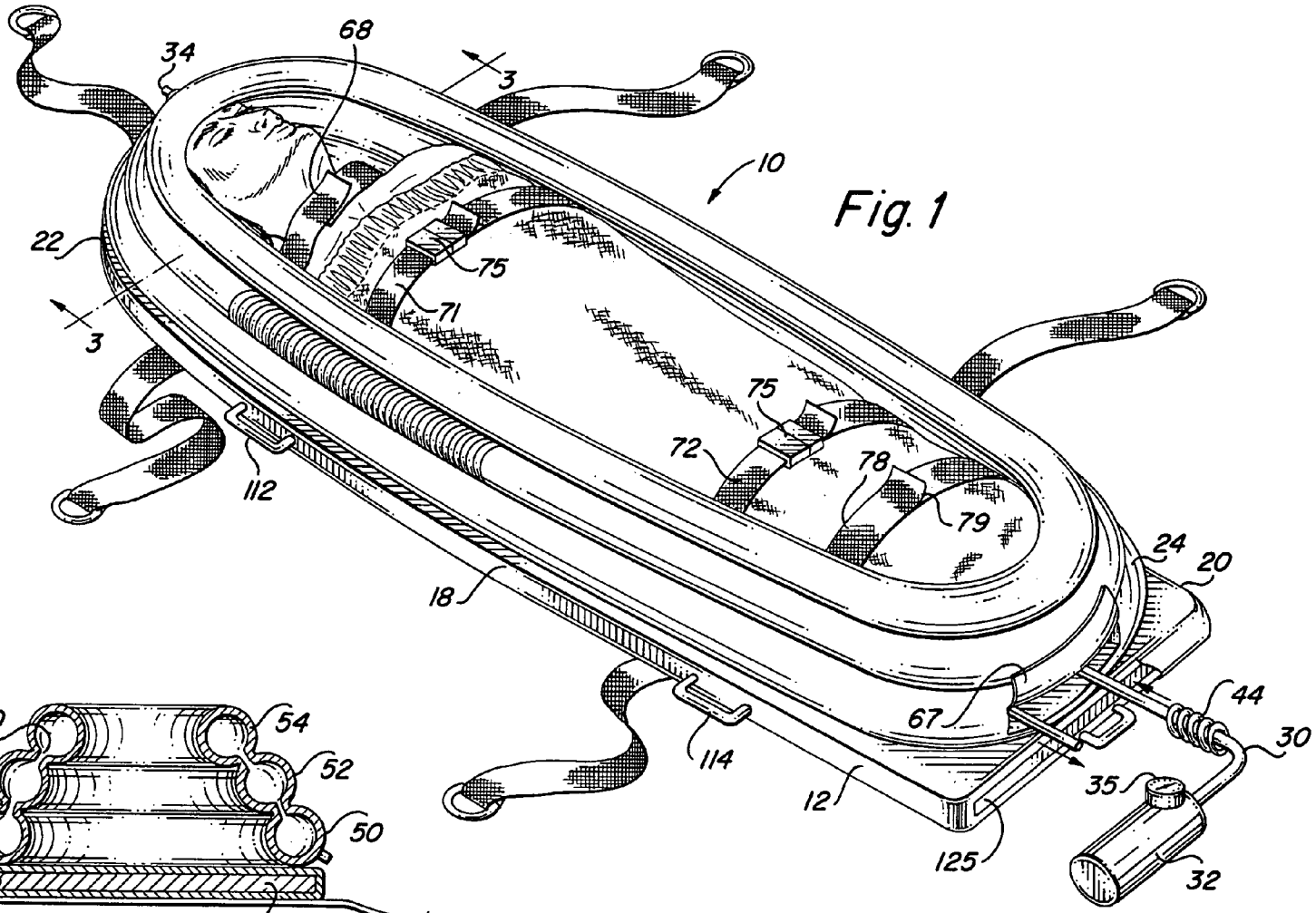
FIG. 1 is a perspective view of the immobilization device of the present invention shown with an accident victim secured in a stabilized position in the device.

The present invention relates to a medical device for immobilizing the victim of an accident or injury and is intended to be primarily utilized by first responding emergency medical personnel arriving on the scene. An understanding of the advantages and features of the present invention are further facilitated by a brief description of the conventional procedures and protocols followed by emergency medical personnel when arriving at an accident injury scene. The first responder, such as an EMT or Paramedic, will initially assess the situation and the condition of the patient. The acronym ABC is for a procedure involving checking the patient's airway, breathing and circulation. Obvious medical problems are treated first and an assessment is conducted for conditions such as heart attack, stroke, bleeding, open fractures, burns, trauma wounds and the like. The emergency personnel must also assess the less obvious conditions such as internal bleeding, drug reaction and the attendant will often assume for the safety of the patient there is the possibility for spinal damage. It is often practice to place a device as an extrication collar around the patient and position the immobilized patient on a conventional spinal board as described above. Once the patient is immobilized on the board, the patient can be transported by vehicle such as an ambulance or helicopter to a medical facility. During this period, the medical personnel will take the patient's vital signs such as blood pressure, respiration and heart beat and be attentive for any conditions such as sweating and pain. Emergency treatment may include sanitizing wounds, bandaging, splinting, administering IVs and monitoring conditions such as blood pressure and other vital signs.

The immobilization device of the present invention facilitates both the administration of conventional procedures and protocols outlined above and also will accommodate these procedures and extrication from a wide variety of accident injury situations.

Turning now to the drawings, the immobilization device of the present invention is generally designated by the numeral 10 and includes an underlying base 12. The base 12 is generally planar having upper surface 14 and lower surface 16 and a generally rectangular shape having opposite sides 18 and 20 and opposite ends 22 and 24. The sides 14, 16 may be slightly tapered toward the upper end 22 of the support. The base 12 may be made from any suitable, impervious material, preferably a strong, light weight, durable fabric of 1000 denier nylon, polyester, polyethylene, heavy duty canvas or synthetic materials such as Rip Stop Nylon. Material used in rafts and inflatable boats works well. Materials such as these are radio opaque so an immobilized patient may be scanned or x-rayed.

The device 10 may be provided in several sizes. For most adult sizes, the device will measure approximately 24" to 26" wide and 70" to 74" long which will accommodate most adult individuals in a supine position. Pediatric and infant sizes will be smaller.

Extending longitudinally along the center of the upper surface of the base 12 is a resilient cushion which is shown being one or more air tubes 25. The air tubes are interconnected to an air chamber which, in turn, is connected to a rapid inflation device 32 at inlet 30. Air tubes 26 extend transversely at the upper end of the base in the head and cervical area of the patient. The air inflating device may be a source of air such as a high speed inflation device such as a compressed air source such as used to inflate life vests and inflatable boats and rafts. It is important that the inflation system operate to inflate the device quickly not requiring an electrical connection so the device may be used in a variety of situations even in remote, hard to reach areas. The inflation is observed by monitor or gauge 35 so the desired pressure is achieved. Relief valve 34 allows the attendant to adjust the inflation in accordance with the patient's condition, size and medical considerations. The inflation should be about 3.0 psi so when inflated, the base becomes rigid. In some instances, it may be desirable to heat the air supplied to the device using a small electric resistance heater 44 if available. The heater may be battery powered or connectable to a power source on a vehicle. Heated air is desirable in situations where the patient is possibly suffering from hypothermia. The heater may be stored beneath a flap in a pocket 67 in the device. The inlet 30 is flexible to allow the inflation device to be inserted and removed from pocket 67.

The resilient base, once inflated, provides for the comfort and stabilizing of the patient and assists in protecting the patient against bumps and shocks that may occur during movement and transportation.

Figure 3:
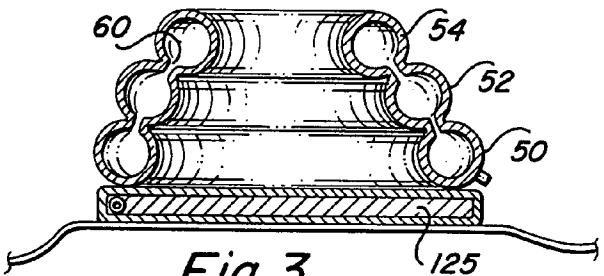
FIG. 3 is a sectional view taken along line 3—3 of FIG. 1.
Figure 4:
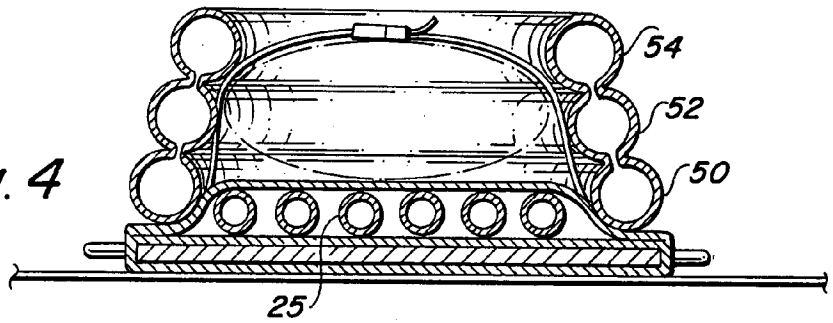
FIG. 4 is a sectional view taken along line 4—4 of FIG. 1.
Figure 5:
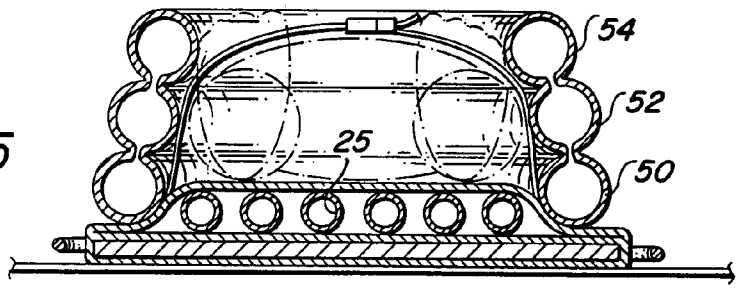
FIG. 5 is a sectional view taken along line 5—5 of FIG. 1.
Figure 2:
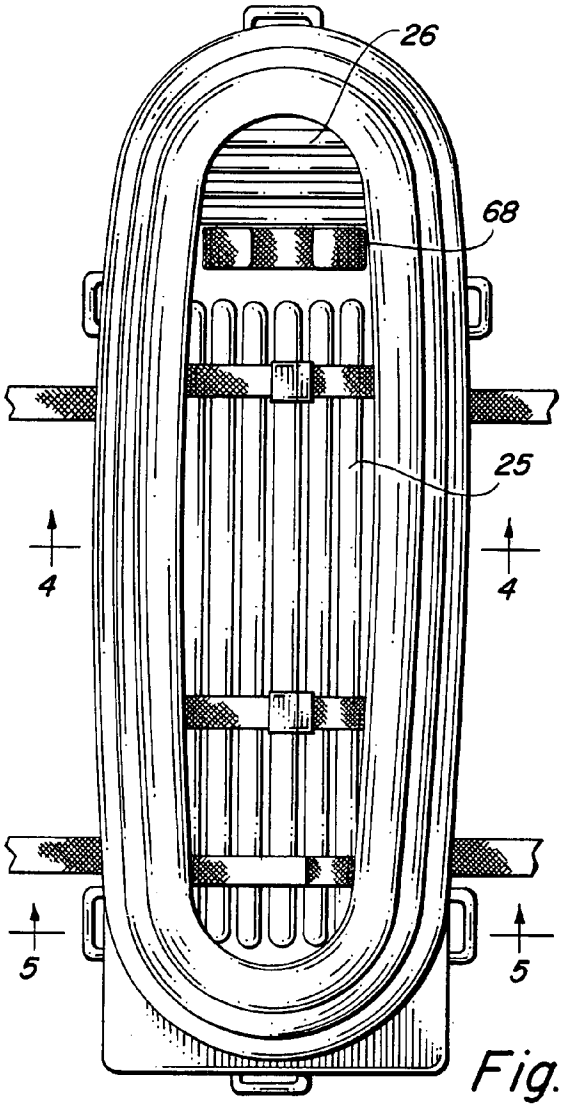
FIG. 2 is a top view of the immobilization device of the present invention shown in an inflated condition without a patient in place to better illustrate the details of the construction.

However, as pointed out above, an important requirement of the emergency treatment of an individual is to fully immobilize the individual particularly if there is concern about spinal injuries. For this purpose, a plurality of immobilizing air channels 50, 52, 54 extend entirely around the periphery on the upper surface of the base 12. Three air channels are shown although a greater or lesser number may work. The channels are generally tubular, including lower channel 50, intermediate channel 52 and upper channel 54. The channels are not vertically stacked but converge inwardly as best seen in FIGS. 3 to 5. The air channels 50, 52, 54 are connected to the air supply 32 so that once a patient is placed on the base, the base and air chambers can be rapidly and automatically inflated against the sides of the patient's body to the desired levels. Note also, as seen in FIG. 1, that the channels extend entirely around the body and the top of the patient's head area and over the feet area so the patient is secured and stabilized. Preferably the air channels are inflated sequentially with the lower-most chamber 50 being inflated first and separately inflation progressing to the intermediate and upper-most air chambers. The chambers are in communication by orifices 60 as seen in FIG. 3 so sequential, controlled inflation occurs.

If desired, a collar 68, such as an extrication collar, may also be extended around the neck area of the patient, as best seen in FIG. 1, secured by Velcro® or other type fastener.

Securement straps 71, 72 may also be provided to extend around the torso and legs of the patient. The upper straps 71 are attached to the base in an area to extend across the chest of the patient and is securable and adjustable at buckles 75. Similar strap sections 72 extend transversely in the lower thigh leg area and are also adjustably securable at conventional buckle-type closures 75. Flexible straps 78 with loop and hook fasteners 79 extend in the more sensitive shin area of the patient. The fasteners are of a material which is radio opaque so the patient may be scanned while in the device without interference.

In some situations, in order to extricate the patient, it may be necessary to lift the stabilized patient and this may occur on rough terrain. Accordingly, tether straps 80, 82 are provided extending along the underside of the device and terminating at D-rings 86 at a center lifting point. The straps may be permanently secured to the underside of the base and generally stored in an out-of-the-way position or may be extended through loops on the underside of the device provided for this purpose when necessary. The straps 80, 82 are joined at a D-ring for a single attachment point for a lift cable.

Figure 11:
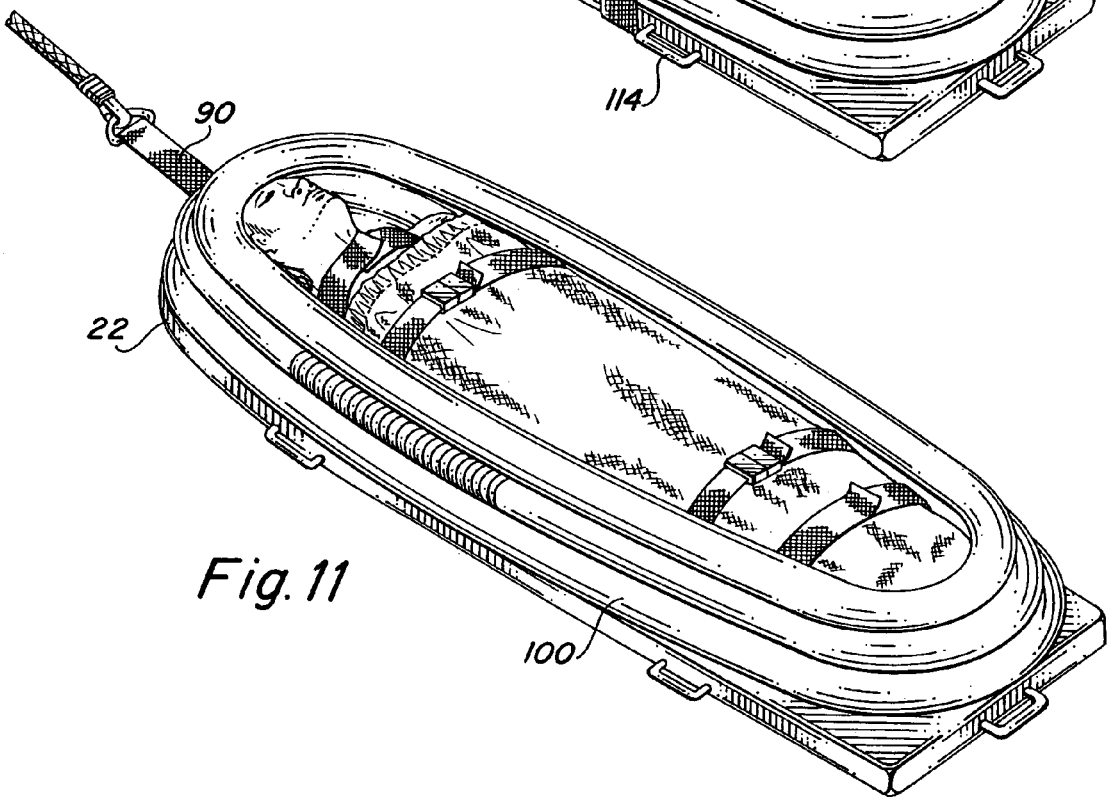
FIG. 11 is a perspective view showing the use device of the present invention in connection with a transportation device such as a Stokes basket.

Another tether 90 extends from the upper end 22 of the device which is primarily used in situations such as shown in FIG. 11 in which the immobilization device is lowered or raised from a rescue location to another location. Also, as shown in FIG. 11, the immobilization device of the present invention may also be used in conjunction with existing rescue devices such as conventional sleds such as Stokes and Jordan devices 100 which receive the device 10.

Flexible straps 110 are affixed to the underside of the base and terminate at handles 112, 114 which may be used to manually lift the device and patient in to and out of emergency vehicles. The handles 112, 114 may be recessed in the air channels or foldable to an out-of-the-way position.

Figure 6:
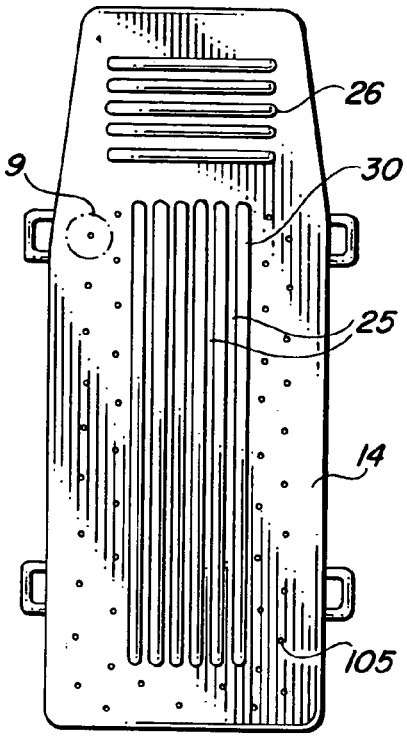
FIG. 6 is a plan view of the inflated base.
Figure 7:
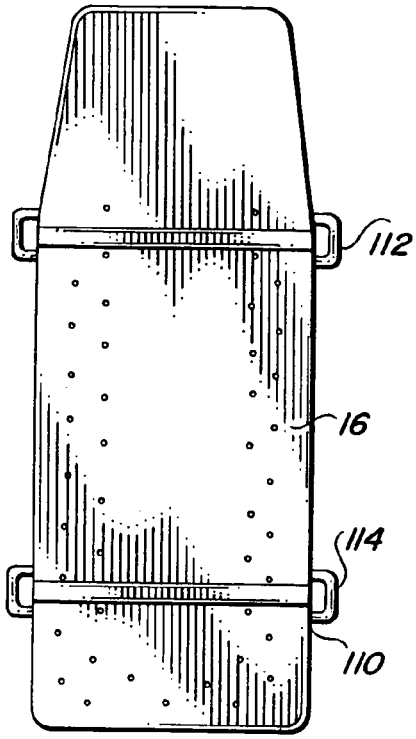
FIG. 7 is a bottom view of the inflated base.
Figure 9:
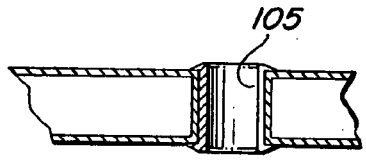
FIG. 9 is a detail of the drain holes extending through the inflated base.

Referring to FIGS. 6 and 7, the base 12 is preferably provided with a plurality of spaced-apart apertures 105. The apertures are shown in detail in FIG. 9 and are provided both for air circulation and drainage of any moisture that may accumulate during a rescue operation. A pocket 125 in the base is provided for insertion of a rigid board such as one of fiberglass which may be needed in certain extreme situations such as mountain rescue.

Figure 8:
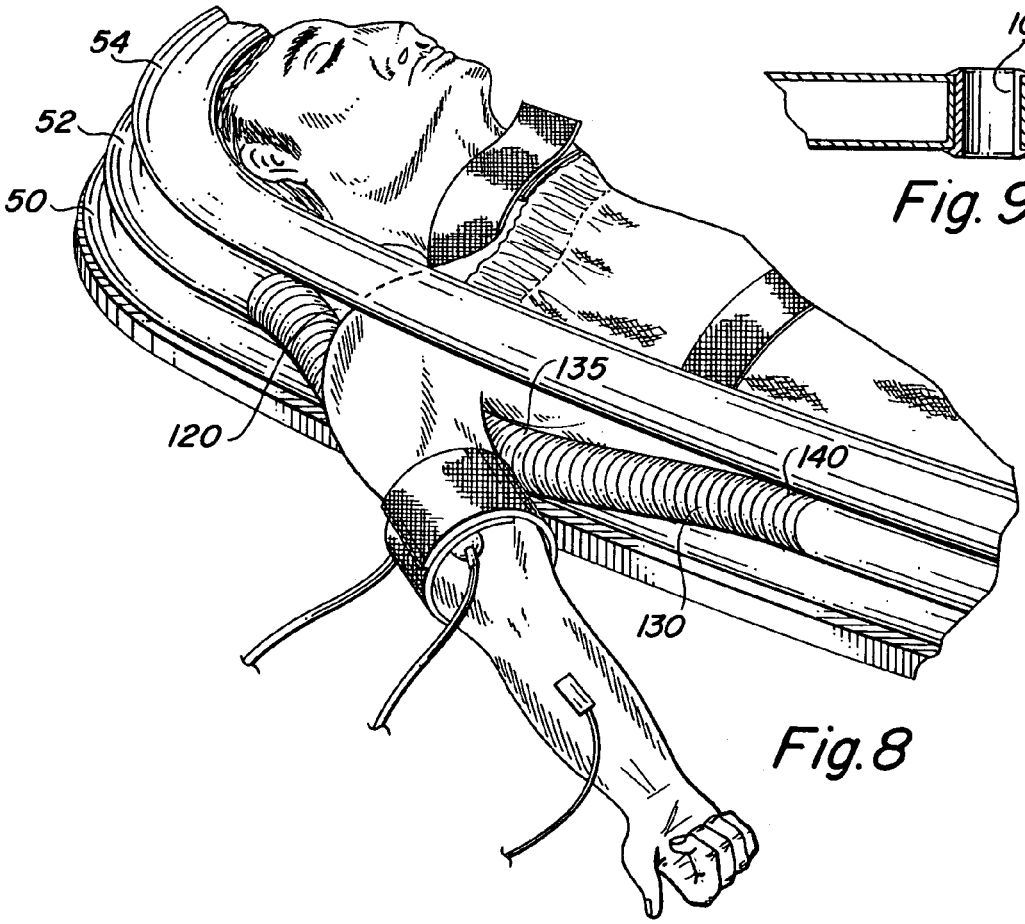
FIG. 8 is a partial perspective view showing an immobilized patient with the patient's arm extending through an access opening between the inflatable air channels.
Figure 10:
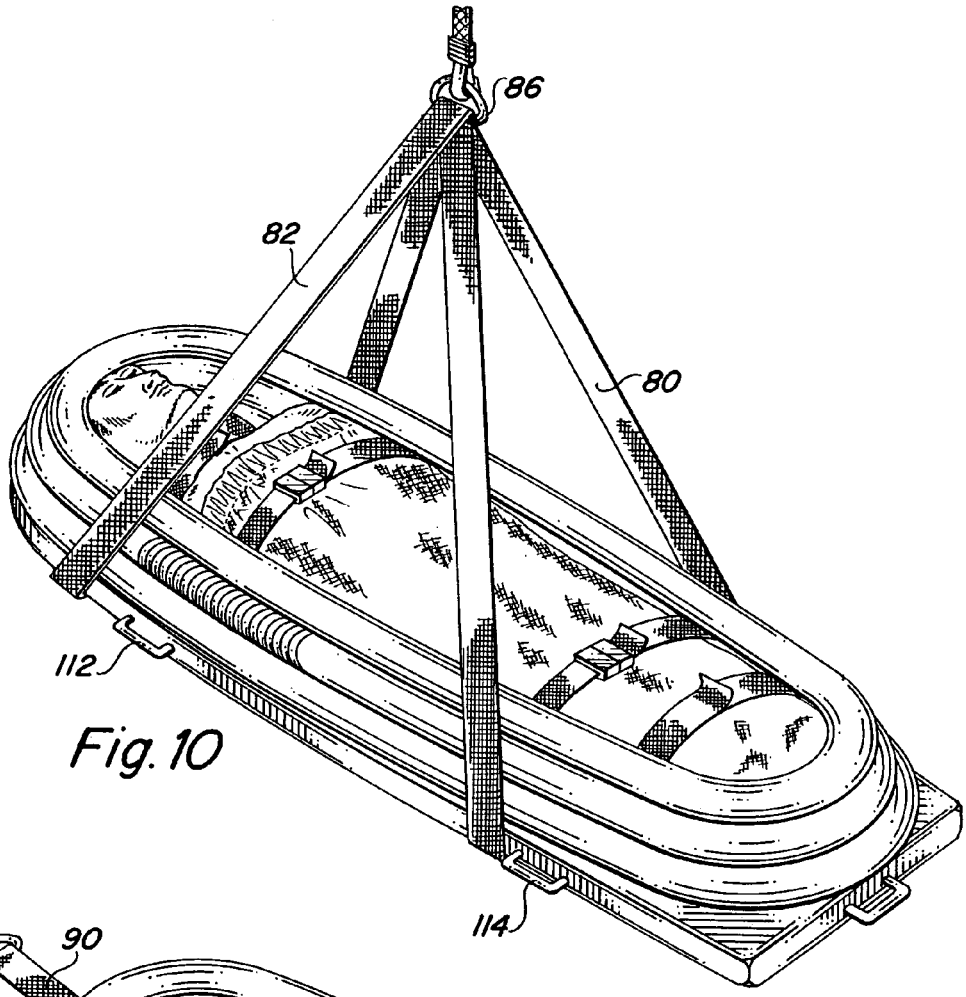
FIG. 10 is a perspective view showing the device of the present invention connected to a lift or hoist as may be used in an air rescue.

As indicated in above, it is often necessary for first responding medical personnel to assess and monitor a patient's condition and initially administer emergency treatment. This may require monitoring vital signs and administering IVs. With conventional backboards and even with some devices having inflatable restraints, access to the patient is made difficult and sometimes restrictive, as the restraint interferes with medical procedures. Referring to Figure 8, the immobilization device of the present invention 10 accommodates access to a patient's limbs even while the patient is fully immobilized. Accordingly, intermediate the inflatable stabilizer tubes 52, 54 is a longitudinal extending opening 120 along both sides of the device. The opening 120 is in an area generally corresponding to the location of a patient's arm. The opening 120 provides access to the arm. A similar opening may be provided at other longitudinal locations along the device.

Air tube 130 has an access section 135 which is expandable and retractable having a plurality of circumferential ribs 140 similar to the construction of vacuum and vent hoses. In this area, the expandable access section 135 is not joined to the air tubes which extend above and below the expandable section. In the normal position, the expandable section would assume a position as shown in FIG. 1. However, when it is necessary to access the patient's limb, medical personnel can simply separate the tubes at section 135, as shown in FIG. 8, allowing the patient's arm to extend outwardly through the opening to provide access for attachment of a blood pressure cuff and an IV as shown. The patient remains stable and immobilized and the limb may be returned to a position along the side of the patient.

From the foregoing it will be seen the present invention provides a unique immobilization device which will provide comfort and support during initial treatment and subsequent transportation to a medical facility. The device is relatively inexpensive, efficient in use and may be conveniently stored in an uninflated configuration in a knapsack-type bag. The device is extremely versatile as it is adaptable to a wide variety of emergency situations. The device is reusable and conforms to the physiology of the particular patient to securely immobilize the patient.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A device for immobilizing a patient comprising:

(a) an inflatable base having top and bottom surfaces, opposite side and ends;

(b) a first inflatable air channel, located on said top surface extending along said sides and ends and defining a patient receiving area;

(c) a second inflatable air channel on said first air channel extending around said patient receiving area, said first and second air channels when inflated converging inwardly toward said patient receiving area to extend around the patient's body and over the top of the head and feet to immobilize the patient; and (d) inflating means for inflating said base and said first and second air channels.

2. The immobilizing device of claim 1 wherein said base has a pocket for removably receiving a rigid insert.

3. The immobilizing device of claim 1 further including at least one belt extending transversely of said base having fastener means for securement to the patient.

4. The immobilizing device of claim 1 wherein said base includes cushioning means.

5. The immobilizing device of claim 1 wherein said base defines at least one aperture for moisture removal.

6. The immobilizing device of claim 1 further including a lift strap having a first end secured to said base and a second end securable to a lifting attachment.

7. The immobilizing device of claim 1 further including a cervical collar in the said patient receiving area.

8. The immobilizing device of claim 1 wherein said inflating means comprises rapid self inflating means.

9. The immobilizing device of claim 1 further including a third inflatable air channel on said second air channel and extending peripherally about said patient receiving area.

10. The immobilizing device of claim 1 further including access means for accessing the patient for administering medical treatment.

11. The immobilizing device of claim 10 wherein said access means comprises a displaceable flexible section between adjacent air channels.

12. The immobilizing device of claim 1 wherein said device is substantially radio opaque.

13. The immobilizing device of claim 1 including heating means for heating the inflating air.

14. The immobilizing device of claim 1 including air relief means for adjusting the degree of inflation in said air channels.

15. The immobilizing device of claim 1 wherein said base and channels are a durable fabric material.

16. A device for immobilizing a patient comprising:

(a) an inflatable base having top and bottom surfaces, opposite side and ends said base having a pocket for removably receiving a rigid insert;

(b) a first inflatable air channel extending peripherally about said base, said air channel having an inner edge defining a patient receiving area;

(c) a second inflatable air channel on said first air channel peripherally extending around said patient receiving area, said second air channel when inflated extending inwardly toward said patient receiving area past the inner edge of said first air channel; and (d) inflating means for inflating said first and second air channels whereby patient supinely positioned in said patient receiving area will be restrained by said air channels and supported on said base.

* * * * *